US008205880B2

(12) United States Patent
Kimura et al.

(10) Patent No.: US 8,205,880 B2
(45) Date of Patent: Jun. 26, 2012

(54) SHEET FEEDING DEVICE AND SKEW DETECTING METHOD

(75) Inventors: Keisuke Kimura, Ishikawa (JP); Shigeru Yonemura, Ishikawa (JP); Takeshi Kimura, Ishikawa (JP)

(73) Assignee: PFU Limited, Ishikawa (JP)

( * ) Notice: Subject to any disclaimer, the term of this patent is extended or adjusted under 35 U.S.C. 154(b) by 230 days.

(21) Appl. No.: 12/022,010

(22) Filed: Jan. 29, 2008

(65) Prior Publication Data

US 2008/0265497 A1 Oct. 30, 2008

(30) Foreign Application Priority Data

Apr. 27, 2007 (JP) ..... 2007-118909

(51) Int. Cl.
*B65H 7/08* (2006.01)

(52) U.S. Cl. ..... 271/261

(58) Field of Classification Search ..... 271/227, 271/259, 228, 261
See application file for complete search history.

(56) References Cited

U.S. PATENT DOCUMENTS

| | | | | |
|---|---|---|---|---|
| 4,602,778 | A * | 7/1986 | Hirose et al. | 271/227 |
| 4,941,377 | A * | 7/1990 | Ishihara et al. | 83/211 |
| 6,089,563 | A * | 7/2000 | Takashimizu et al. | 271/117 |
| RE37,007 | E * | 1/2001 | Gerlier | 250/548 |
| 6,269,995 | B1 * | 8/2001 | Rich et al. | 226/17 |
| 6,641,134 | B1 * | 11/2003 | Dobbertin et al. | 271/226 |
| 7,427,061 | B2 * | 9/2008 | Ruthenberg et al. | 271/122 |
| 7,530,256 | B2 * | 5/2009 | deJong et al. | 73/1.37 |
| 2002/0145249 | A1 * | 10/2002 | Acquaviva et al. | 271/228 |
| 2005/0263958 | A1 * | 12/2005 | Knierim et al. | 271/272 |
| 2006/0159470 | A1 * | 7/2006 | Yasukawa et al. | 399/21 |
| 2006/0250292 | A1 * | 11/2006 | Yamagata | 341/192 |
| 2008/0136092 | A1 * | 6/2008 | Elliot | 271/228 |
| 2008/0136094 | A1 * | 6/2008 | Elliot | 271/270 |
| 2008/0237975 | A1 * | 10/2008 | de Jong et al. | 271/228 |
| 2009/0033027 | A1 * | 2/2009 | Sato | 271/228 |

FOREIGN PATENT DOCUMENTS

| | | |
|---|---|---|
| JP | 03-264429 | 11/1991 |
| JP | 04-125241 | 4/1992 |
| JP | 08-106565 | 4/1996 |
| JP | 10-073891 | 3/1998 |
| JP | 2006-193287 A | 7/2006 |

OTHER PUBLICATIONS

Office Action for JP2007-118909 mailed Dec. 20, 2011.

* cited by examiner

*Primary Examiner* — Jeremy R Severson
(74) *Attorney, Agent, or Firm* — Lowe, Hauptman, Ham & Berner, LLP

(57) ABSTRACT

A plurality of moving-amount detecting units respectively detects a moving amount of the sheet fed by a feeding unit at a plurality of points in a width direction of the sheet. A skew detecting unit detects a skew of the sheet based on the moving amount of the sheet detected by the moving-amount detecting units.

11 Claims, 4 Drawing Sheets

SHEET FEEDING DEVICE AND SKEW DETECTING METHOD

RELATED APPLICATIONS

The present application is based on, and claims priority from, Japan Application Number 2007-118909, filed Apr. 27, 2007, the disclosure of which is hereby incorporated by reference herein in its entirety.

BACKGROUND OF THE INVENTION

1. Field of the Invention

The present invention relates to a sheet feeding device and a skew detecting method, and more particularly, to a sheet feeding device capable of feeding a plurality of sheets by separating the sheets one by one and a skew detecting method applicable to the sheet feeding device.

2. Description of the Related Art

An apparatus that processes a plurality of sheets, for example, an image reading apparatus such as an image scanner, a copier, a facsimile machine, or a character recognition device includes a sheet feeding device. The sheet feeding device separates stacked sheets one by one, and sequentially feeds the separated sheet to the image reading apparatus. Even when a number of sheets are stacked, the apparatus can process the sheets one by one because the sheets are automatically fed one by one. However, in such a sheet feeding device, if some of the sheets are stapled in the stack, the stapled sheets may rotate around a stapled portion, and are skewed with respect to a feeding direction because the sheets are fed even though the stapled sheets cannot move separately due to the stapling. As a result, corners of the sheets are folded and bent, and thus it may cause a damage on the sheets or a feed error, so-called a jam. A skew of a sheet may occur not only when stapled sheets are mistakenly placed in the stack, but also, for example, when a sheet being fed is caught on something else.

In a sheet feeding device disclosed in Japanese Patent Application Laid-open No. 2006-193287, a pick roller is provided at an end portion of a hopper on which sheets are stacked to pick the sheets stacked on the hopper to convey them into the device, so that the sheets are separated one by one by a separator roller and a brake roller included in a separating unit, and then fed into the apparatus. Moreover, the sheet feeding device includes a plurality of sheet detecting units arranged downstream of the separating unit to be aligned in parallel to one another in a sheet width direction (a direction perpendicular to a sheet feeding direction). In each of a plurality of detecting intervals between each two of the sheet detecting units, a skew angle is obtained based on a time difference between the sheet detecting units where a leading edge of the sheet passes through and positions of the sheet detecting units, and when a difference between the obtained skew angles exceeds a threshold, the sheet feeding device detects a skew of the leading edge of the sheet.

However, in the above sheet feeding device, a skew due to a rotation or a deformation of the sheet is detected in such a manner that each of the sheet detecting units detects a passage of the leading edge of the sheet by obtaining a skew angle with respect to the width direction based on the time difference between passages of the leading edge of the sheet through each of the sheet detecting units. Therefore, if the sheet is skewed after the leading edge of the sheet passes through the sheet detecting units, the sheet feeding device may fail to detect the skew.

SUMMARY OF THE INVENTION

It is an object of the present invention to at least partially solve the problems in the conventional technology.

According to an aspect of the present invention, there is provided a sheet feeding device including a feeding unit that feeds a sheet; a plurality of moving-amount detecting units for respectively detecting a moving amount of the sheet fed by the feeding unit at a plurality of points in a width direction of the sheet; and a skew detecting unit that detects a skew of the sheet based on the moving amount of the sheet detected by the moving-amount detecting units.

Furthermore, according to another aspect of the present invention, there is provided a skew detecting method including first detecting including detecting a moving amount of a sheet that is fed at a plurality of points in a width direction of the sheet; and second detecting including detecting a skew of the sheet based on the moving amount detected at the first detecting.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings. The present invention is not limited to the embodiments.

A sheet feeding device according to an embodiment of the present invention automatically feeds stacked sheets S as sheet-like media by separating the sheet S one by one. The sheet feeding device according to the embodiment is included in, for example, an image reading apparatus as an apparatus processing a plurality of sheets S, such as an image scanner, a copier, a facsimile machine, or a character recognition device. The sheet feeding device separates stacked sheets S one by one, and sequentially feeds the separated sheet S to the image reading apparatus. In the embodiment explained below, the sheet feeding device is applied to the image reading apparatus; however, the sheet feeding device can be applied to any other apparatuses, such as a sheet-fed printing press.

Figure 1:
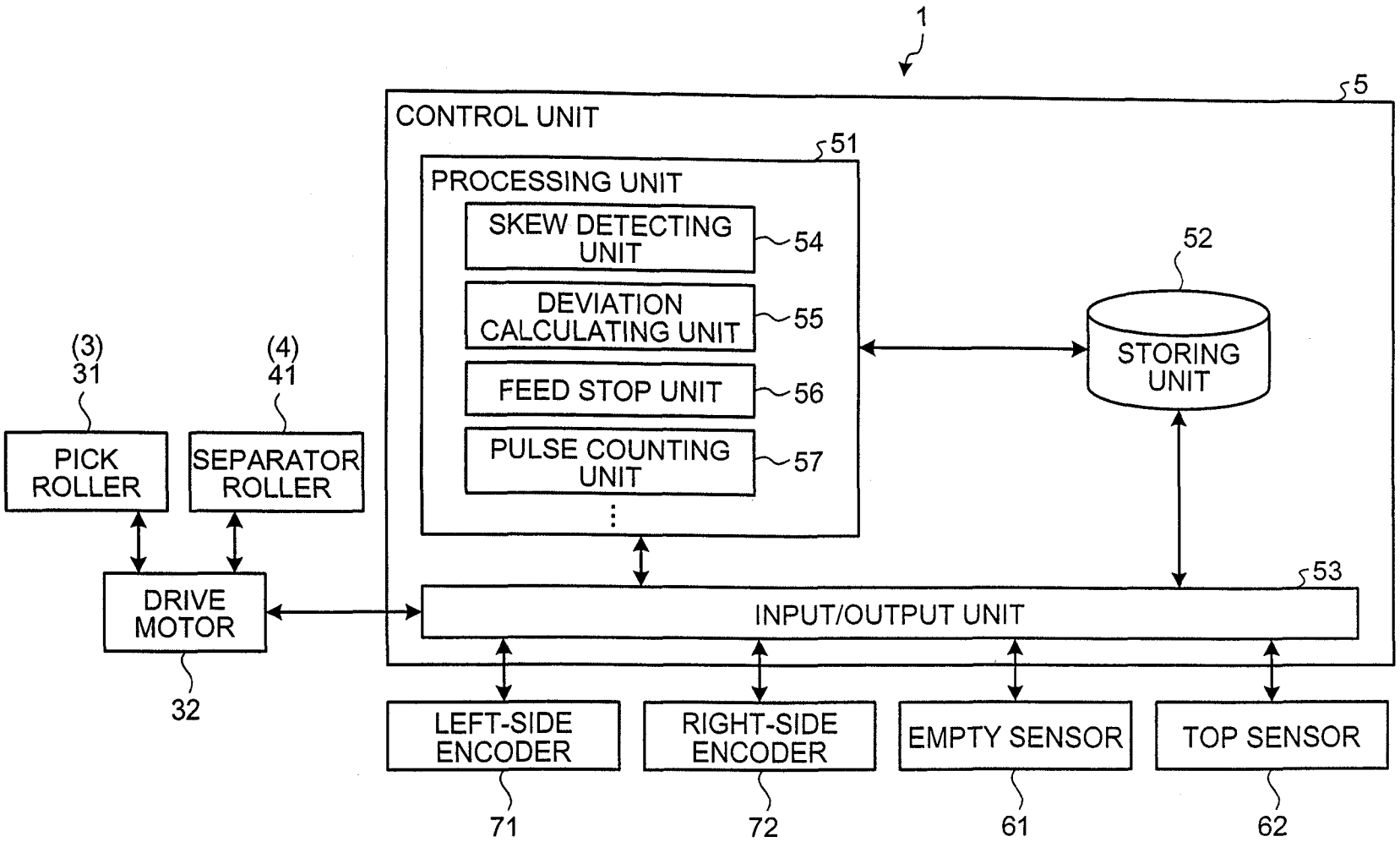
FIG. 1 is a block diagram of a sheet feeding device according to an embodiment of the present invention.
Figure 2:
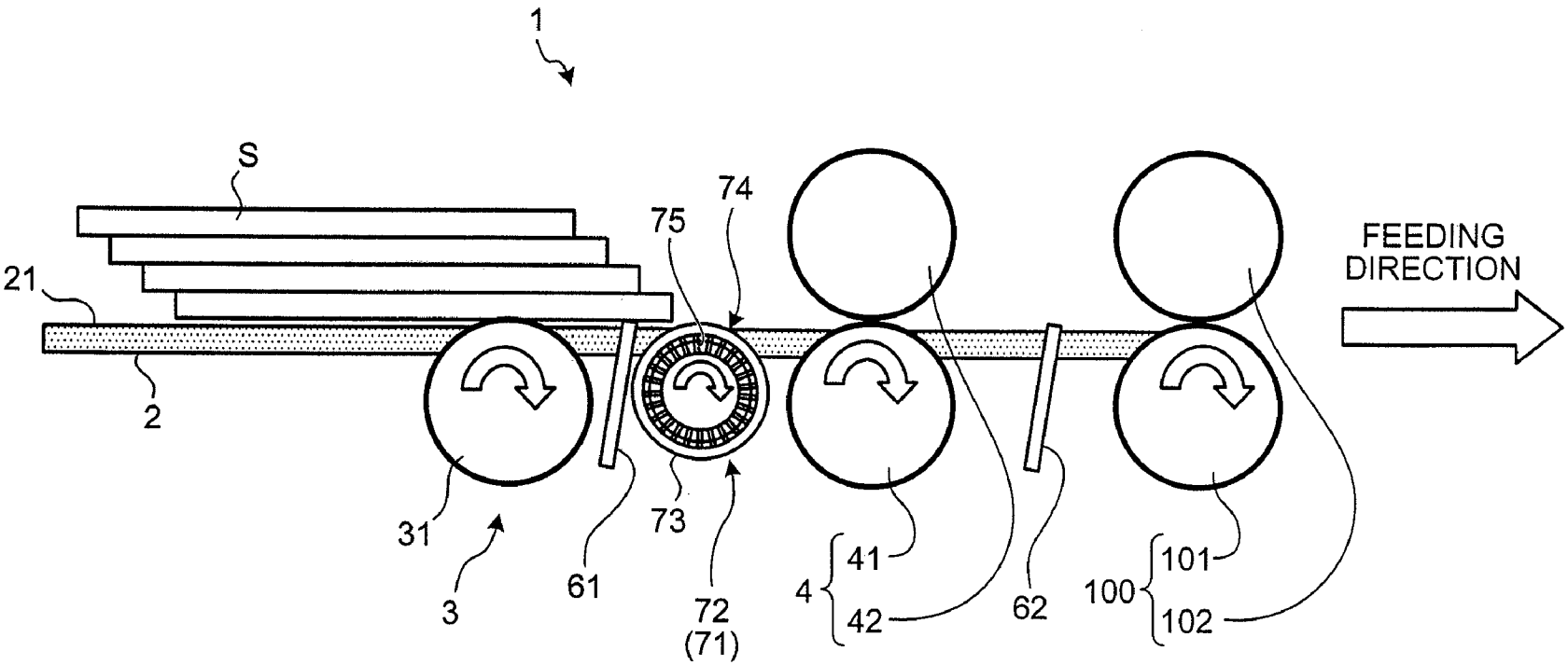
FIG. 2 is a side view of an image reading apparatus including the sheet feeding device.

FIG. 1 is a block diagram of a sheet feeding device 1 according to the embodiment. FIG. 2 is a side view of the sheet feeding device 1 and the image reading apparatus.

The sheet feeding device 1 automatically and sequentially feeds a plurality of sizes and a massive amount of sheets S to a conveying unit 100 included in the image reading apparatus. The sheet feeding device 1 includes a sheet stacking table 2 as a stacking unit, a feeding unit 3, a separating unit 4, and a control unit 5. The sheets S are stacked on the sheet stacking table 2. The feeding unit 3 feeds the sheets S stacked on the sheet stacking table 2. The separating unit 4 separates the sheets S fed by the feeding unit 3 one by one. The control unit 5 includes a microcomputer, and controls the sheet feeding device 1.

Incidentally, a direction of which a sheet S is fed by the sheet feeding device 1 is referred to as a feeding direction, and a direction perpendicular to both the feeding direction and a thickness direction of the sheet S is referred to as a width direction. The feeding unit 3 and the separating unit 4 are arranged along the feeding direction with keeping a predetermined distance between them. The feeding unit 3 is located at the upstream side of the feeding direction, and the separating unit 4 is located at the downstream side of the feeding direction. The conveying unit 100 is located the downstream side of the separating unit 4 in the feeding direction.

The conveying unit 100 conveys the sheet S fed from the sheet feeding device 1 to any other unit in the image reading apparatus. For example, an optical unit as an image reading unit is provided on a sheet conveying path of the conveying unit 100, whereby an image on the sheet S is read by the optical unit while the sheet S is conveyed inside the image reading apparatus by the conveying unit 100.

The conveying unit 100 includes a drive roller 101 and a driven roller 102. The drive roller 101 is driven to rotate around a central axis as a rotating shaft. By a rotation transmission from the drive roller 101, the driven roller 102 rotates around a central axis as a rotating shaft in accordance with the rotation of the drive roller 101. The drive roller 101 and the driven roller 102 have substantially the same length of a cylindrical shape, respectively. The drive roller 101 and the driven roller 102 are arranged in such a way that the central axes of the drive roller 101 and the driven roller 102 intersect with the feeding direction of the sheet S, i.e., along the width direction of the sheet S. The driven roller 102 and the drive roller 101 are oppositely arranged to have contact with each other, and the driven roller 102 is biased towards the drive roller 101 by a biasing unit (not shown). When the sheet S is conveyed, the drive roller 101 is driven to rotate in such a direction that an outer circumferential surface of the drive roller 101 moves from the side of the separating unit 4 to the inner side of the image reading apparatus at a contact portion where the drive roller 101 has contact with the driven roller 102 (in a clockwise direction as indicated by an arrow shown in FIG. 2), and by the rotation transmission from the drive roller 101, the driven roller 102 also rotates in such a direction that an outer circumferential surface of the driven roller 102 moves from the side of the separating unit 4 to the inner side of the image reading apparatus at a contact portion where the driven roller 102 has contact with the drive roller 101. With the bias applied to the driven roller 102, the sheet S is sandwiched between the outer circumferential surface of the drive roller 101 and the outer circumferential surface of the driven roller 102, and conveyed in accordance with the rotation of the drive roller 101. Then, the sheet S is transferred by sequentially-passing between a plurality of drive rollers (not shown) and driven rollers (not shown), which are oppositely arranged to have contact with each other along the sheet conveying path, and conveyed to any other unit in the image reading apparatus, such as the optical unit.

The sheet stacking table 2 has a rectangular-shaped stacking surface 21. A plurality of sheets S is stacked on the stacking surface 21. The sheets S stacked on the sheet stacking table 2 are pressed towards the stacking surface 21 by a biasing unit (not shown).

The feeding unit 3 includes a pick roller 31. The pick roller 31 is used to feed the bottommost sheet S of the sheets S stacked on the sheet stacking table 2. The pick roller 31 is made of a material with a large frictional force such as a foamed rubber, and has a cylindrical shape. A central axis of the pick roller 31 is set up substantially parallel to a width direction of the stacking surface 21, i.e., along the stacking surface 21 and also in a direction perpendicular to the feeding direction of the sheet S. In addition, the pick roller 31 is set up in such a way that the central axis of the pick roller 31 is located on the side of a bottom surface of the sheet stacking table 2 (on the side opposite to the stacking surface 21 on which the sheets S are stacked), and an outer circumferential surface of the pick roller 31 is exposed at the stacking surface 21. Incidentally, the sheets S are stacked on the stacking surface 21 in such a way that trailing edges (edges in the upstream side of the feeding direction) of the sheets S are located in the upstream side of the pick roller 31 in the feeding direction.

The pick roller 31 is connected to a drive motor 32 as a driving unit via a transmission gear (not shown) and a belt (not shown), and driven to rotate around the central axis as a rotating shaft by the application of a rotation drive force from the drive motor 32. The pick roller 31 is driven to rotate in a pick direction, i.e., a direction of which the outer circumferential surface of the pick roller 31 moves to the side of the conveying unit 100 at the stacking surface 21 (in a clockwise direction as indicated by an arrow shown in FIG. 2). Incidentally, to downsize the image reading apparatus, the drive roller 101 is also connected to the drive motor 32 via a transmission gear (not shown) and a belt (not shown). In other words, the pick roller 31 and the drive roller 101 share the drive motor 32. Alternatively, it is also possible to provide another drive motor for driving the drive roller 101 separately.

The separating unit 4 includes a separator roller 41 and a brake roller 42. The separator roller 41 is made of a material with a large frictional force such as a foamed rubber, and has a cylindrical shape. The separator roller 41 is located in the downstream side of the pick roller 31 in the feeding direction, and arranged substantially parallel to the pick roller 31. In other words, a central axis of the separator roller 41 is set up along the stacking surface 21 and also in a direction perpendicular to the feeding direction of the sheet S. In addition, the separator roller 41 is set up in such a way that the central axis of the separator roller 41 is located on the side of the bottom surface of the sheet stacking table 2, and an outer circumferential surface of the separator roller 41 is exposed at the stacking surface 21. To downsize the sheet feeding device 1, the separator roller 41 is also connected to the drive motor 32 via a transmission gear (not shown) and a belt (not shown), and driven to rotate around the central axis as a rotating center by the application of the rotation drive force from the drive motor 32. In other words, the pick roller 31 and the separator roller 41 share the drive motor 32. Alternatively, it is also possible to provide another drive motor for driving the separator roller 41 separately. In the same manner as the pick roller 31, the separator roller 41 is driven to rotate in such a direction that the outer circumferential surface of the separator roller 41 moves to the side of the conveying unit 100 at the stacking surface 21 (in a clockwise direction as indicated by an arrow shown in FIG. 2).

The brake roller 42 has a cylindrical shape of substantially the same length as that of the separator roller 41. In the same manner as the separator roller 41, a central axis of the brake roller 42 is set up to intersect with the feeding direction of the sheet S, i.e., along the width direction of the sheet S. The brake roller 42 is arranged on the side of the stacking surface 21 to be opposed to the separator roller 41 with having contact with the separator roller 41, and biased towards the separator roller 41 by a biasing unit (not shown). By a rotation transmission from the separator roller 41, the brake roller 42 rotates around the central axis as a rotating shaft in accordance with the rotation of the separator roller 41 in such a direction that an outer circumferential surface of the brake roller 42 moves to the side of the conveying unit 100 at a contact portion where the brake roller 42 has contact with the separator roller 41.

The control unit 5 is electrically connected to the drive motor 32, an empty sensor 61, and a top sensor 62. The empty sensor 61 is arranged between the pick roller 31 and the separator roller 41 in the side close to the pick roller 31. The empty sensor 61 detects whether there is any sheet S which trailing edge is located in the upstream side of the pick roller 31 on the stacking surface 21. Specifically, the empty sensor 61 detects whether there is any sheet S on the stacking surface 21 by detecting a leading edge (an edge in the downstream side of the feeding direction) of the sheet S which trailing edge (edge in the upstream side of the feeding direction) is located in the upstream side of the pick roller 31. The top sensor 62 is arranged between the separator roller 41 and the drive roller 101. The top sensor 62 detects whether there is any sheet S located in the downstream side of the separating unit 4. The empty sensor 61 and the top sensor 62 respectively transmit a signal indicating a result of the detection to the control unit 5. As the empty sensor 61 and the top sensor 62, a photo sensor using an infrared radiation or the like is employed in the embodiment. Alternatively, for example, an ultrasonic sensor can be employed instead of the photo sensor.

As the pick roller 31 is driven to rotate in the pick direction (in the clockwise direction as indicated by the arrow shown in FIG. 2), the bottommost sheet S is picked from the sheets S stacked on the stacking surface 21 by the outer circumferential surface of the pick roller 31, and fed towards the conveying unit 100. When the bottommost sheet S is fed by the pick roller 31, it may happen that a sheet S other than the bottommost sheet S (for example, a sheet S on top of the bottommost sheet S) is also fed to the separator roller 41 along with the bottommost sheet S due to a frictional force generated between the sheets S in accordance with the feed of the bottommost sheet S. In this case, the sheet S fed along with the bottommost sheet S can be separated from the bottommost sheet S by the separator roller 41 and the brake roller 42.

Namely, while a leading edge of the bottommost sheet S is held between the separator roller 41 and the brake roller 42, the sheet S fed along with the bottommost sheet S is blocked not to be fed in the downstream side of the feeding direction by having contact with the brake roller 42, so that the sheet S fed along with the bottommost sheet S is stopped at the upstream side of the brake roller 42. After the bottommost sheet S is fed to the downstream side of the separator roller 41 and the brake roller 42 in accordance with the rotation of the separator roller 41, a leading edge of the sheet S stopped at the upstream side of the brake roller 42 is held between the separator roller 41 and the brake roller 42, and then fed to the downstream side of the separator roller 41 and the brake roller 42 in accordance with the rotation of the separator roller 41. In this manner, the sheet S fed along with the bottommost sheet S is separated from the bottommost sheet S by the separator roller 41 and the brake roller 42, and only the bottommost sheet S is fed towards the conveying unit 100.

In the above embodiment, the brake roller 42 is biased towards the separator roller 41 by the biasing unit (not shown). Alternatively, the brake roller 42 can be driven to rotate in a direction opposite to the rotating direction of the separator roller 41 instead of providing the biasing unit.

Figure 3:
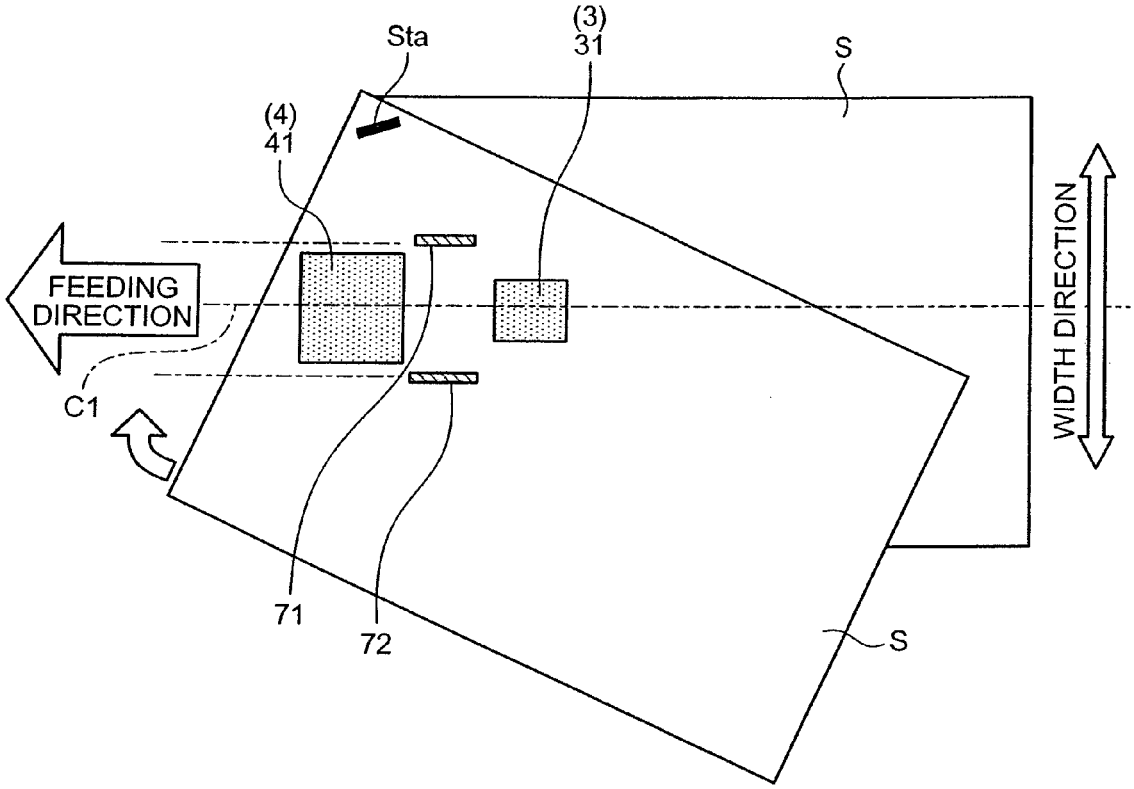
FIG. 3 is an overhead view of the sheet feeding device.

FIG. 3 is an overhead view of the sheet feeding device 1. As shown in FIG. 3, when some sheets S are corner-stapled and mistakenly stacked on the stacking surface 21, if the corner-stapled sheets S are fed by the feeding unit 3 even though a movement of the corner-stapled sheets is limited due to a stapled portion Sta, the corner-stapled sheets S are skewed with respect to the feeding direction because the corner-stapled sheets S rotate around the stapled portion Sta. As a result, it may cause a damage on the stapled sheets S because the stapled sheets S are folded and bent, or it may occur a feed error, so-called a jam, in the separating unit 4. Such a skew of the sheets S may occur not only when a plurality of sheets S is stapled but also, for example, when a sheet S while being fed is caught on something else.

To prevent such problems, a left-side encoder 71 and a right-side encoder 72 as moving-amount detecting units, and a skew detecting unit 54 are provided to the sheet feeding device 1. The left-side encoder 71 and the right-side encoder 72 respectively detect a moving amount of the sheet S fed by the feeding unit 3 at a plurality of points in the width direction of the sheet S. The skew detecting unit 54 detects a skew of the sheet S while being fed based on the moving amounts detected by the left-side encoder 71 and the right-side encoder 72.

As the left-side encoder 71 and the right-side encoder 72, a rotary encoder is employed in the embodiment. As shown in FIG. 2, the left-side encoder 71 and the right-side encoder 72 respectively include an encode disk 73 as a disk-shaped rotational body. An encode pattern 74 is formed on side surfaces of the encode disk 73 along its circumference. The encode pattern 74 is composed of a plurality of slits 75 that are radially arranged at predetermined intervals along the circumference. The encode disks 73 of the left-side encoder 71 and the right-side encoder 72 are arranged in the downstream side of the pick roller 31 and also in the upstream side of the separator roller 41 in the feeding direction. The encode disks 73 of the left-side encoder 71 is arranged on the left side of a width centerline C1 of the sheet S viewed from the side of the stacking surface 21 to the downstream side of the feeding direction. On the other hand, the encode disks 73 of the right-side encoder 72 is arranged on the right side of the width centerline C1 viewed from the side of the stacking surface 21 to the downstream side of the feeding direction. At this time, it is assumed that the sheet S is stacked on the stacking surface 21 properly, i.e., in such a way that the width of the sheet S is set up perpendicular to the feeding direction. In addition, the encode disks 73 are symmetrically arranged across the width centerline C1 along the width direction of the sheet S.

The sheet feeding device 1 shown in FIG. 3 is viewed from the side of the pick roller 31 towards the downstream side of the feeding direction. Therefore, in the sheet feeding device 1 shown in FIG. 3, the left-side encoder 71 is depicted on the right side of the width centerline C1, and the right-side encoder 72 is depicted on the left side of the width centerline C1. Incidentally, the pick roller 31, the separator roller 41, and the brake roller 42 are arranged on the width centerline C1.

Each of the encode disks 73 is arranged substantially parallel to the pick roller 31 and the separator roller 41. In other words, a central axis of each of the encode disks 73 is set up along the stacking surface 21 and also in a direction perpendicular to the feeding direction of the sheet S. In addition, each of the encode disks 73 is set up in such a way that the central axis of the encode disk 73 is located on the side of the bottom surface of the sheet stacking table 2, and an outer circumferential surface of the encode disk 73 is exposed at the stacking surface 21. When the sheet S is fed to the separator roller 41 by the pick roller 31, the outer circumferential surfaces of the encode disks 73 have contact with the sheet S, so that in accordance with the movement of the sheet S, each of the encode disks 73 having contact with the sheet S rotates around the central axis as a rotating shaft in a clockwise direction as indicated by an arrow shown in FIG. 2.

A light emitting unit (not shown) such as a light-emitting diode and a light receiving unit (not shown) such as a photo transistor are provided on both sides of the encode disk 73. When a light emitted from the light emitting unit passes through the slits 75, the light receiving unit can receive the light. On the other hand, when a light emitted from the light emitting unit is blocked by a portion other than the slits 75, the light receiving unit cannot receive the light. The light is blocked or passes through the slits 75 in accordance with the rotation of the encode disk 73. Consequently, the left-side encoder 71 and the right-side encoder 72 can detect an electrical pulse signal corresponding to a rotational displacement or an angular rate of the encode disk 73 depending on whether the light receiving unit receives the light emitted from the light emitting unit in accordance with the rotation of the encode disk 73, i.e., based on the encode pattern 74 composed of the slits 75.

The left-side encoder 71 and the right-side encoder 72 respectively detect a moving amount of the sheet S by detecting a rotational displacement of each of the encode disks 73 because each of the encode disks 73 rotates in accordance with the movement of the sheet S, so that the rotational displacement of each of the encode disks 73 corresponds to the moving amount of the sheet S. Therefore, the left-side encoder 71 and the right-side encoder 72 can detect the moving amounts of the sheet S because each of the encode disks 73 rotates by having contact with the sheet S in accordance with the movement of the sheet S. The left-side encoder 71 and the right-side encoder 72 are electrically connected to the control unit 5, and respectively transmit a pulse signal corresponding to the rotation of each of the encode disks 73 to the control unit 5.

Figure 4:
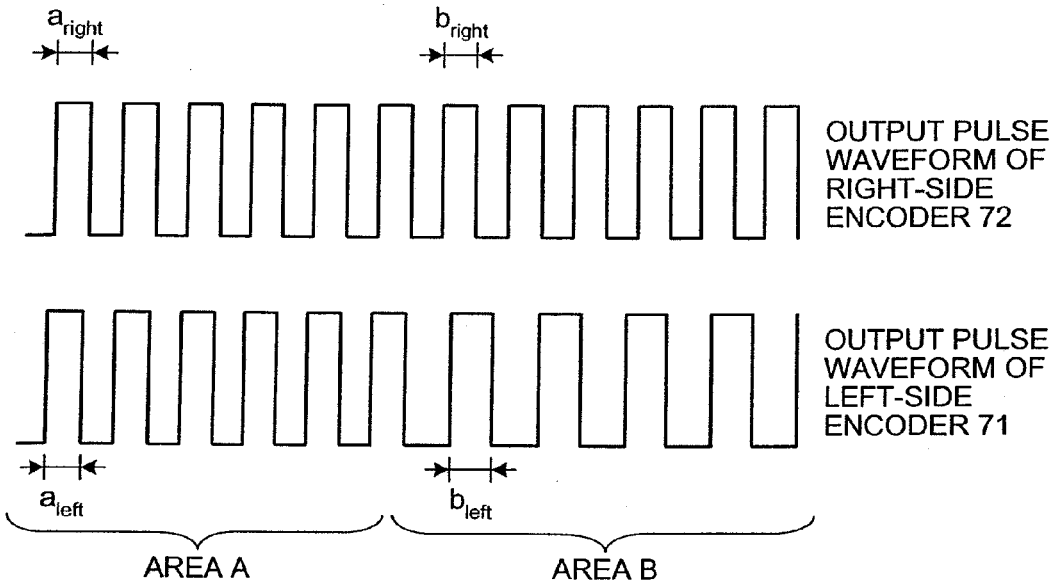
FIG. 4 is an example of output pulse waveforms of pulse signals output from encoders shown in FIG. 3.

FIG. 4 is an example of output pulse waveforms of pulse signals output from the left-side encoder 71 and the right-side encoder 72. Pulse widths $a_{left}$ and $b_{left}$ of the output pulse waveform of the pulse signal output from the left-side encoder 71 and pulse widths $a_{right}$ and $b_{right}$ of the output pulse waveform of the pulse signal output from the right-side encoder 72 are inversely proportional to a moving rate of the sheet S relative to each of the encode disks 73. Namely, as the moving rate of the sheet S increases, i.e., as a rotation rate of each of the encode disks 73 increases, an interval between a light passage and a light blockage by the encode pattern 74 is shortened, and thus a pulse width of the output pulse waveform narrows (for example, see the pulse widths $a_{left}$, $a_{right}$, and $b_{right}$ shown in FIG. 4). On the other hand, as the rotation rate of each of the encode disks 73 decreases, the interval of the light passage and the light blockage is lengthened, and thus a pulse width of the output pulse waveform widens (for example, see the pulse width $b_{left}$ shown in FIG. 4).

In other words, as the moving rate of the sheet S increases, a moving amount of the sheet S per unit time increases. Therefore, as the moving amount of the sheet S increases, the rotation rate of each of the encode disks 73 increases, and thus the pulse width narrows. On the other hand, as the moving amount of the sheet S decreases, the rotation rate of each of the encode disks 73 decreases, and thus the pulse width widens. Consequently, it indicates that the moving amount of the sheet S increases in an area in which the pulse width of the output pulse waveform narrows, conversely, the moving amount of the sheet S decreases in an area in which the pulse width of the output pulse waveform widens.

As described above, the encode disks 73 of the left-side encoder 71 and the encode disks 73 of the right-side encoder 72 are respectively arranged on the left side and the right side of the width centerline C1 of the sheet S properly-stacked on the stacking surface 21 in the width direction as viewed from the side of the stacking surface 21 to the downstream side of the feeding direction. Therefore, the left-side encoder 71 detects a moving amount of the sheet S on the left side of the width centerline C1 in the width direction, and transmits a pulse signal corresponding to the detected moving amount to the control unit 5. On the other hand, the right-side encoder 72 detects a moving amount of the sheet S on the right side of the width centerline C1 in the width direction, and transmits a pulse signal corresponding to the detected moving amount to the control unit 5. Specifically, the encode disk 73 of the left-side encoder 71 and the encode disk 73 of the right-side encoder 72 are symmetrically arranged across the width centerline C1 along the width direction, so that the encode disk 73 of the left-side encoder 71 and the encode disk 73 of the right-side encoder 72 respectively detect a moving amount of the sheet S at a symmetrical position on each side of the width centerline C1.

Furthermore, both the encode disks 73 of the left-side encoder 71 and the right-side encoder 72 rotate by having contact with the sheet S in accordance with the movement of the sheet S, and the left-side encoder 71 and the right-side encoder 72 respectively detect a moving amount of the sheet S based on the encode pattern 74 formed on each of the encode disks 73. Therefore, as the sheet S moves in the feeding direction relative to each of the encode disks 73, the left-side encoder 71 and the right-side encoder 72 respectively can detect the moving amount of the sheet S in whole area of the sheet S along the feeding direction.

The left-side encoder 71 and the right-side encoder 72 are preferred to be arranged within a feed area in which the available minimum size of the sheet S is fed by the feeding unit 3. Namely, the left-side encoder 71 and the right-side encoder 72 are preferred to be arranged within an area depending on the minimum size of the sheet S that can be fed by the feeding unit 3 so that the left-side encoder 71 and the right-side encoder 72 can detect moving amounts of both edges of the sheet S having the minimum width in the width direction. Thus, even in a case of the sheet S of the minimum size that can be fed by the sheet feeding device 1, the left-side encoder 71 and the right-side encoder 72 can respectively detect a moving amount of the sheet S.

The control unit 5 is a computer such as a personal computer. As shown in FIG. 1, the control unit 5 includes a processing unit 51, a storing unit 52, and an input/output (I/O) unit 53. The processing unit 51 and the storing unit 52 are connected to each other. The processing unit 51 is further connected to the drive motor 32, the empty sensor 61, the top sensor 62, the left-side encoder 71, and the right-side encoder 72 via the I/O unit 53.

The storing unit 52 stores therein a computer software program causing to execute a sheet damage preventing process including a skew detecting process with a sheet damage preventing method including a skew detecting method according to the present invention. The storing unit 52 is composed of any one or a combination of a hard disk device, a magneto-optical disk device, a nonvolatile memory (a read-only memory medium) such as a compact disk read-only memory (CD-ROM) or a flash memory, and a volatile memory such as a random access memory (RAM).

The computer software program can be combined with other computer software program, which is stored in a computer system in advance, so as to execute the sheet damage preventing process including the skew detecting process. Alternatively, the computer software program capable of exercising a function of the processing unit 51 can be stored in a computer-readable recording medium so that the computer system reads the computer software program from the recording medium to execute the sheet damage preventing process including the skew detecting process. Incidentally, it is assumed that the "computer system" includes hardware such as an operating system (OS) and a peripheral device. The storing unit 52 can be built in the processing unit 51 or included in other devices (for example, a database server).

The processing unit 51 includes a memory (not shown) and a central processing unit (CPU) (not shown). When the sheet damage preventing process including the skew detecting process is executed, the processing unit 51 calculates by reading the computer software program into the memory included in the processing unit 51 in accordance with predetermined procedures of the sheet damage preventing method including the skew detecting method. At this time, the processing unit 51 arbitrarily stores a calculated value obtained in midstream of the calculation in the storing unit 52, and keeps performing the calculation with the value fetched out from the storing unit 52. Alternatively, such a function of the processing unit 51 can be exercised with a dedicated hardware instead of the computer software program.

The processing unit 51 includes the skew detecting unit 54, a deviation calculating unit 55, a feed stop unit 56, and a pulse counting unit 57. As described above, the skew detecting unit 54 detects a skew of the sheet S based on moving amounts of the sheet S detected by the left-side encoder 71 and the right-side encoder 72.

The pulse counting unit 57 counts the number of pulses of each of output pulse waveforms of pulse signals output from the left-side encoder 71 and the right-side encoder 72. The number of pulses counted by the pulse counting unit 57 corresponds to a moving amount of the sheet S. Therefore, when the pulse width of the output pulse waveform narrows, the number of pulses counted per unit time increases, so that a moving amount of the sheet S increases when the number of pulses relatively increases. On the other hand, when the pulse width of the output pulse waveform widens, the number of pulses counted per unit time decreases, so that a moving amount of the sheet S decreases when the number of pulses relatively decreases. The pulse counting unit 57 counts the number of pulses depending on changes in a rising edge and a falling edge of the output pulse waveform. The skew detecting unit 54 detects a skew of the sheet S based on a result of the counting by the pulse counting unit 57, i.e., the number of pulses corresponding to the moving amount of the sheet S.

The deviation calculating unit 55 calculates a deviation of the number of pulses counted by the pulse counting unit 57 based on each of the moving amounts detected by the left-side encoder 71 and the right-side encoder 72. A deviation between the number of pulses corresponding to the moving amount detected by the left-side encoder 71 and the number of pulses corresponding to the moving amount detected by the right-side encoder 72 is used as a standard value, i.e., a value indicating a deviation and a displacement of an edge of the sheet S with respect to the other edge of the sheet S. In this case, the deviation calculating unit 55 calculates an absolute value of a difference between the number of pulses as the deviation. Therefore, as the deviation calculated by the deviation calculating unit 55 increases, a difference between the moving amounts of the sheet S detected by the left-side encoder 71 and the right-side encoder 72 increases.

When either one of the left-side encoder 71 and the right-side encoder 72 does not detect a moving amount of the sheet S, and also a moving amount of the sheet S detected by the other encoder is equal to or larger than a threshold Th1 for determining a skew of a leading edge of the sheet S, the skew detecting unit 54 detects a skew of a leading edge of the sheet S. The skew of a leading edge of the sheet S occurs in such a case that the sheet S is set up askew on the stacking surface 21 from the beginning. Such a skew is referred to as a leading edge skew. In addition, when a deviation calculated by the deviation calculating unit 55 is equal to or larger than a threshold Th2 for determining a cumulative skew, the skew detecting unit 54 detects a skew of the sheet S while being fed by the feeding unit 3. The skew of the sheet S while being fed occurs in such a case that corner-stapled sheets S are mistakenly fed, and rotate around a stapled portion Sta or are deformed while the corner-stapled sheets S are fed, though the corner-stapled sheets S are set up properly on the stacking surface 21. Such a skew is referred to as a cumulative skew. In either case of the leading edge skew or the cumulative skew, if the skewed sheet S is kept being fed, it may cause a damage on the sheet S or a feed error, so-called a jam. Therefore, when the skew detecting unit 54 detects a skew of the sheet S, the feed stop unit 56 stops rotation of the pick roller 31 and the separator roller 41 by controlling the drive motor 32 so as to stop feeding the sheet S. Consequently, it is possible to prevent an occurrence of a damage on the sheet S or a jam.

Incidentally, the threshold Th1 can be suitably set depending on a degree of the skew allowable by the sheet feeding device 1, and the threshold Th2 can be suitably set within a range in which a rotation or a deformation of the sheet S can be detected depending on, for example, positions of the left-side encoder 71 and the right-side encoder 72.

Figure 5:
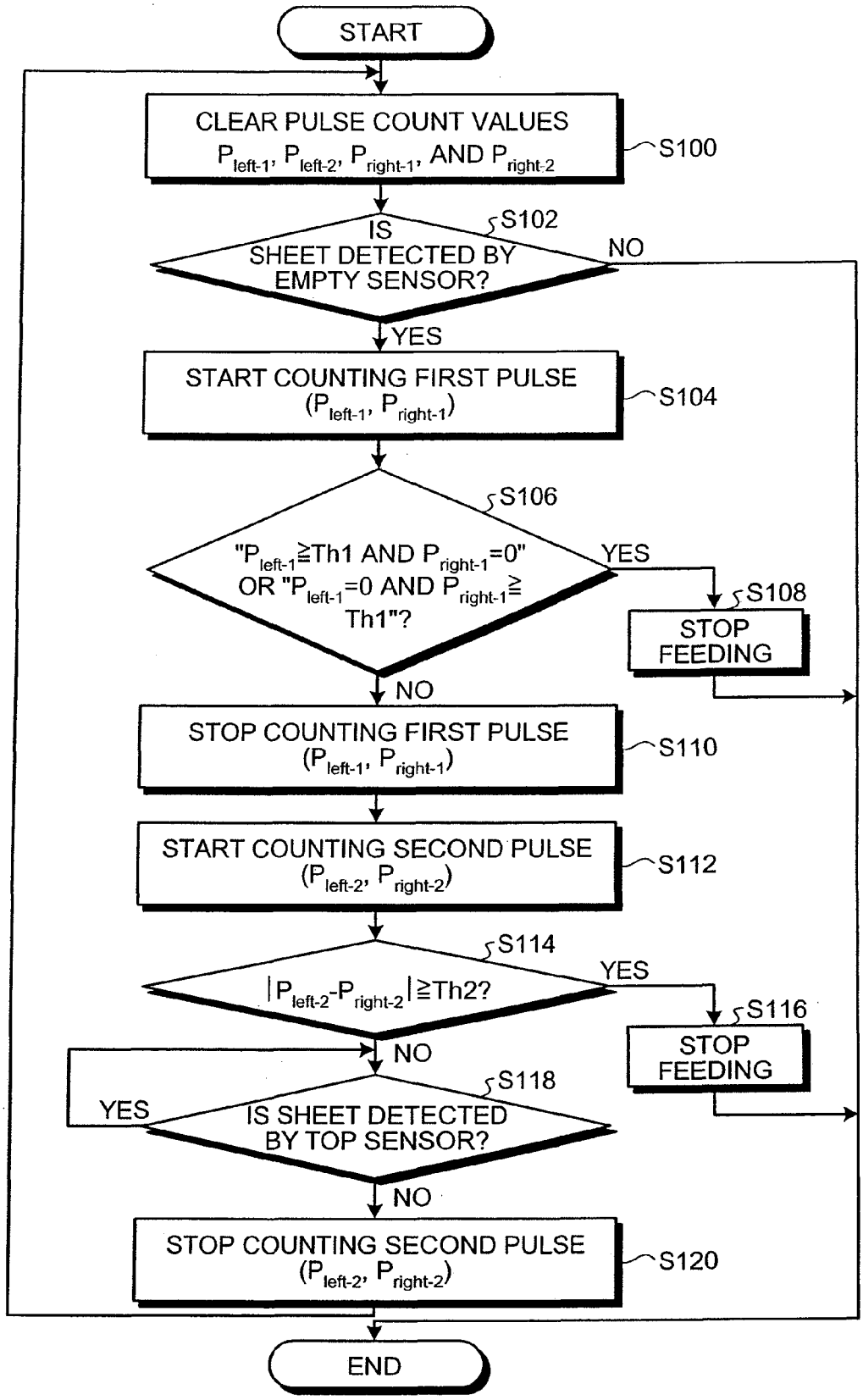
FIG. 5 is a flowchart of a skew detecting process performed by the sheet feeding device.

The sheet damage preventing process including the skew detecting process performed by the sheet feeding device 1 is explained in detail below with reference to a flowchart shown in FIG. 5. When the control unit 5 causes the drive motor 32 to start driving, and the sheet feeding device 1 starts feeding a sheet S, the pulse counting unit 57 clears all of pulse count values $P_{left\text{-}1}$, $P_{right\text{-}1}$, $P_{left\text{-}2}$, and $P_{right\text{-}2}$ (Step S100). The pulse count values $P_{left\text{-}1}$ and $P_{left\text{-}2}$ are respectively the first and second pulse count values of an output pulse waveform of a pulse signal output from the left-side encoder 71. The pulse count values $P_{right\text{-}1}$ and $P_{right\text{-}2}$ are respectively the first and second pulse count values of an output pulse waveform of a pulse signal output from the right-side encoder 72.

The control unit 5 determines whether the sheet S is detected by the empty sensor 61 (Step S102). If the control unit 5 determines that the sheet S is not detected by the empty sensor 61 (NO at Step S102), i.e., if the control unit 5 determines that no sheet S is stacked on the stacking surface 21, the process is terminated. On the other hand, if the control unit 5 determines that the sheet S is detected by the empty sensor 61 (YES at Step S102), i.e., if the control unit 5 determines that the sheet S is stacked on the stacking surface 21, as a first moving-amount detecting step, the pulse counting unit 57 starts counting the number of the first pulses of each of output pulse waveforms of pulse signals output from the left-side encoder 71 and the right-side encoder 72 in accordance with the feed of the sheet S by the feeding unit 3 so as to obtain the first pulse count values $P_{left\text{-}1}$ and $P_{right\text{-}1}$ (Step S104). For example, each of the first pulse count values $P_{left\text{-}1}$ and $P_{right\text{-}1}$ is incremented by one every time a rising edge is detected in each of the output pulse waveforms.

Then, as a first skew detecting step, the skew detecting unit 54 determines whether "$P_{left\text{-}1} \geqq Th1$ and $P_{right\text{-}1}=0$" or "$P_{left\text{-}1}=0$ and $P_{right\text{-}1} \geqq Th1$" is satisfied (Step S106). In other words, the skew detecting unit 54 determines whether either one of the left-side encoder 71 and the right-side encoder 72 does not detect any movement of the sheet S, and also the number of pulses corresponding to a moving amount of the sheet S detected by the other encoder is equal to or larger than the threshold Th1.

When the sheet S is set up properly on the stacking surface 21, i.e., when the sheet S is set up in such a way that the actual width direction of the sheet S is perpendicular to the feeding direction, and fed by the feeding unit 3, both the encode disks 73 of the left-side encoder 71 and the right-side encoder 72 start rotating almost simultaneously by having contact with the sheet S. However, if the sheet S is set up askew on the stacking surface 21 from the beginning, a leading edge (an edge in the downstream side of the feeding direction) of the sheet S is tilted at a predetermined angle with respect to the width direction perpendicular to the feeding direction. In this condition, when the sheet S is fed by the feeding unit 3, either one of the encode disks 73 starts rotating in advance of the other encode disk 73, and then the other encode disk 73 starts rotating late. The longer time it takes from when one of the encode disks 73 starts rotating in advance till when the other encode disk 73 starts rotating late, the more the leading edge of the sheet S is tilted with respect to the width direction. Namely, when either one of the encode disks 73 does not rotate, i.e., when either one of the first pulse count values $P_{left\text{-}1}$ and $P_{right\text{-}1}$ remains at zero, if the other first pulse count value becomes equal to or larger than the threshold Th1 in accordance with the rotation of the other encode disk 73, it indicates that the leading edge of the sheet S is tilted at an angle exceeding an acceptable range with respect to the width direction, so that the skew detecting unit 54 can detect a leading edge skew of the sheet S.

Therefore, if the skew detecting unit 54 determines that "$P_{left\text{-}1} \geqq Th1$ and $P_{right\text{-}1}=0$" or "$P_{left\text{-}1}=0$ and $P_{right\text{-}1} \geqq Th1$" is satisfied (YES at Step S106), i.e., if the leading edge of the sheet S is tilted at an angle exceeding the acceptable range with respect to the width direction, the skew detecting unit 54 detects a leading edge skew of the sheet S, and the feed stop unit 56 causes the pick roller 31 and the separator roller 41 to stop rotating by controlling the drive motor 32 so as to stop feeding the sheet S, as a feed stop step (Step S108), and then the process is terminated. Consequently, it is possible to prevent an occurrence of a damage on the sheet S or a jam.

On the other hand, if the skew detecting unit 54 determines that "$P_{left\text{-}1} \geqq Th1$ and $P_{right\text{-}1}=0$" or "$P_{left\text{-}1}=0$ and $P_{right\text{-}1} \geqq Th1$" is not satisfied (NO at Step S106), i.e., when both of the encode disks 73 start rotating, it indicates that the leading edge of the sheet S is tilted at an angle within the acceptable range with respect to the width direction, so that the feeding unit 3 keeps feeding the sheet S, and the pulse counting unit 57 stops counting the number of the first pulses for the pulse count values $P_{left\text{-}1}$ and $P_{right\text{-}1}$ (Step S110), and starts counting the number of the second pulses to obtain the second pulse count values $P_{left\text{-}2}$ and $P_{right\text{-}2}$, as a second moving-amount detecting step (Step S112).

The deviation calculating unit 55 calculates an absolute value of a difference between the second pulse count values $P_{left\text{-}2}$ and $P_{right\text{-}2}$ as a deviation, and the skew detecting unit 54 determines whether "$|P_{left\text{-}2}-P_{right\text{-}2}| \geqq Th2$" is satisfied, as a second skew detecting step (Step S114). In other words, the skew detecting unit 54 determines whether the deviation calculated by the deviation calculating unit 55 is equal to or larger than the threshold Th2.

For example, as shown in FIG. 3, when corner-stapled sheets S are mistakenly set up on the stacking surface 21, and fed to the separating unit 4 by the feeding unit 3, and the bottommost sheet S of the corner-stapled sheets S is going to be separated from the other sheets S by the separating unit 4, the corner-stapled sheets S rotate around a stapled portion Sta in a clockwise direction as indicated by an arrow shown in FIG. 3 due to the stapling. In this case, the left-side encoder 71 detects a moving amount of the sheets S at a nearer point to a rotating center of the sheets S, i.e., the stapled portion Sta as compared with a point where the right-side encoder 72 detects a moving amount of the sheets S, so that a rotation radius of the sheets S at the point where the left-side encoder 71 detects the moving amount of the sheets S is relatively smaller than that is at the point where the right-side encoder 72 detects the moving amount of the sheet S. Therefore, the moving amount of the sheet S detected by the left-side encoder 71 is smaller than that is detected by the right-side encoder 72 (or the moving amount of the sheet S detected by the left-side encoder 71 is virtually zero).

Consequently, as shown in FIG. 4, in an area A in which the corner-stapled sheets S are fed properly, the pulse widths $a_{left}$ and $a_{right}$ of the output pulse waveforms of the left-side encoder 71 and the right-side encoder 72 are almost the same width. On the other hand, in an area B in which the corner-stapled sheets S start rotating because the corner-stapled sheets S reach the separating unit 4, the pulse width $b_{left}$ of the output pulse waveform of the left-side encoder 71 relatively widens, and the pulse width $b_{right}$ of the output pulse waveform of the right-side encoder 72 relatively narrows. As a result of the counting by the pulse counting unit 57, the second pulse count value $P_{right\text{-}2}$ is larger than the second pulse count value $P_{left\text{-}2}$ (i.e., the second pulse count value $P_{left\text{-}2}$ is smaller than the second pulse count value $P_{right\text{-}2}$). If an absolute value of a difference between the second pulse count values $P_{left\text{-}2}$ and $P_{right\text{-}2}$ is equal to or larger than the threshold Th2, it indicates that a rotation amount of the sheets S exceeds an acceptable range, so that the skew detecting unit 54 detects a cumulative skew, i.e., a skew of the sheets S occurred while the sheets S are fed.

The first moving-amount detecting step (Step S104), the first skew detecting step (Step S106), the second moving-amount detecting step (Step S112), and the second skew detecting step (Step S114) correspond to the skew detecting process with the skew detecting method according to the present invention.

In the case explained above, the corner-stapled sheets S are skewed in the separating unit 4. For example, in a case where a sheet S is deformed because the sheet S while being fed is caught on something else, moving amounts of the sheet S detected by the left-side encoder 71 and the right-side encoder 72 are different from each other, so that in the same manner as the case above, it is also possible to detect a skew due to the deformation of the sheet S.

In this case, if the skew detecting unit 54 determines that "$|P_{left\text{-}2}-P_{right\text{-}2}| \geqq Th2$" is satisfied (YES at Step S114), i.e., if a difference between the moving amounts of the sheet S detected by the left-side encoder 71 and the right-side encoder 72 exceeds the acceptable range, the skew detecting unit 54 detects a cumulative skew of the sheet S, and the feed stop unit 56 causes the pick roller 31 and the separator roller 41 to stop rotating by controlling the drive motor 32 so as to stop feeding the sheet S, as the feed stop step (Step S116), and then the process is terminated. Consequently, it is possible to prevent an occurrence of a damage on the sheet S or a jam.

If the skew detecting unit 54 determines that "$|P_{left}_2-P_{right}_2| \geqq Th2$" is not satisfied (NO at Step S114), i.e., if a difference between the moving amounts of the sheet S detected by the left-side encoder 71 and the right-side encoder 72 is within the acceptable range, the control unit 5 determines whether the sheet S is detected by the top sensor 62 (Step S118). If the control unit 5 determines that the sheet S is detected by the top sensor 62 (YES at Step S118), i.e., if a trailing edge of the sheet S does not yet pass through the top sensor 62, the determination at Step S118 is repeated until no sheet S is detected by the top sensor 62. On the other hand, if the control unit 5 determines that no sheet S is detected by the top sensor 62 (NO at Step S118), the pulse counting unit 57 stops counting the number of the second pulses for the second pulse count values $P_{left\text{-}2}$ and $P_{right\text{-}2}$ (Step S120), and the process control returns to Step S100 so that the process is repeatedly performed.

As explained at steps S118 and S120, in the present embodiment, when the trailing edge of the sheet S passes through the top sensor 62, the pulse counting unit 57 stops counting for the second pulse count values $P_{left\text{-}2}$ and $P_{right\text{-}2}$, so that an interval between the top sensor 62 and the empty sensor 61 in the feeding direction is preferred to be set up so as to obtain the sufficiently-large second pulse count values $P_{left\text{-}2}$ and $P_{right\text{-}2}$. As a result, the difference between the second pulse count values $P_{left\text{-}2}$ and $P_{right\text{-}2}$ can increase, and the difference gets clearer. Consequently, it is possible to detect a skew more precisely.

Furthermore, the encode disks 73 of the left-side encoder 71 and the right-side encoder 72 are respectively arranged on the left and right sides across the width centerline C1 of the sheet S, so that when the sheet S is skewed, a difference between moving amounts of the sheet S detected by the left-side encoder 71 and the right-side encoder 72 relatively increases, for example, as compared with a case where the left-side encoder 71 and the right-side encoder 72 are arranged on the same side.

In this manner, the sheet feeding device 1 according to the present embodiment includes the feeding unit 3 that feeds a sheet S, the left-side encoder 71 and the right-side encoder 72 that respectively detect a moving amount of the sheet S fed by the feeding unit 3 at a plurality of points in the width direction of the sheet S, and the skew detecting unit 54 that detects a skew of the sheet S based on the moving amounts of the sheet S detected by the left-side encoder 71 and the right-side encoder 72.

Furthermore, the skew detecting method according to the present embodiment includes the moving-amount detecting step (steps S104 and S112) of detecting moving amounts of the sheet S at a plurality of points in the width direction of the sheet S and the skew detecting step (steps S106 and S114) of detecting a skew of the sheet S based on the moving amounts detected at the moving-amount detecting step (steps S104 and S112).

Specifically, at the moving-amount detecting step, the left-side encoder 71 and the right-side encoder 72 respectively detect a moving amount of the sheet S fed by the feeding unit 3 at two points in the width direction, and the skew detecting unit 54 detects a skew of the sheet S based on the moving amounts of the sheet S. At the skew detecting step, for example, due to a rotation or a deformation of the sheet S, if moving amounts of the sheet S detected at two points in the width direction are different from each other, a skew of the sheet S is detected. Therefore, even after a leading edge of the sheet S passes through the left-side encoder 71 and the right-side encoder 72, it is possible to detect a skew of the sheet S occurred while the sheet S is fed.

Furthermore, for example, when a skew of sheets is detected by detecting a skew pressure generated by a limit of a movement of the sheets due to a stapling and a sheet separating action acted on the sheets in the separating unit, it may fail to detect the skew of the sheets except for a specific type of the sheet because the skew pressure varies depending on a thickness of the sheet. However, the sheet feeding device 1 according to the present embodiment detects a skew of the sheets S based on not the skew pressure but moving amounts of the sheets S, so that it is possible to detect a skew of the sheet S precisely regardless of a thickness or a size of the sheet S.

Furthermore, in the sheet feeding device 1 according to the present embodiment, the left-side encoder 71 and the right-side encoder 72 respectively include the disk-shaped encode disk 73 that rotates in accordance with the movement of the sheet S by having contact with the sheet S, and detect a moving amount of the sheet S with the encode pattern 74 formed on the encode disk 73 along its circumference. Therefore, the sheet S moves in the feeding direction relative to each of the encode disks 73, so that the left-side encoder 71 and the right-side encoder 72 can detect a moving amount of the sheet S in whole area of the sheet S along the feeding direction.

Moreover, the sheet feeding device 1 according to the present embodiment further includes the pulse counting unit 57 that counts the number of output pulses from each of the left-side encoder 71 and the right-side encoder 72. The skew detecting unit 54 detects a skew of the sheet S based on the pulse count values $P_{left\text{-}1}$, $P_{right\text{-}1}$, $P_{left\text{-}2}$, and $P_{right\text{-}2}$ as a result of the counting by the pulse counting unit 57. As the moving amount of the sheet S decreases, the pulse width of the output pulse waveform of each of pulse signals output from the left-side encoder 71 and the right-side encoder 72 widens, so that the number of pulses decreases. On the other hand, as the moving amount of the sheet S increases, the pulse width of the output pulse waveform narrows, so that the number of pulses increases. Therefore, the number of pulses of each of the output pulse waveforms counted by the pulse counting unit 57 can be used as the moving amount of the sheet S because the moving amount of the sheet S corresponds to the number of pulses. Consequently, the skew detecting unit 54 can detect a skew of the sheet S based on the pulse count values $P_{left\text{-}1}$, $P_{right\text{-}1}$, $P_{left\text{-}2}$, and $P_{right\text{-}2}$.

Furthermore, in the sheet feeding device 1 according to the present embodiment, the left-side encoder 71 and the right-side encoder 72 are respectively arranged on the left and right sides across the width centerline C1 of the sheet S, i.e., the encode disks 73 of the left-side encoder 71 and the right-side encoder 72 are respectively arranged on the left and right sides across the width centerline C1. Therefore, when the sheet S is skewed, a difference between moving amounts of the sheet S detected by the left-side encoder 71 and the right-side encoder 72 relatively increases, and thus it is possible to detect the skew of the sheet S more precisely.

Moreover, in the sheet feeding device 1 according to the present embodiment, the left-side encoder 71 and the right-side encoder 72 can detect at least moving amounts of both edges of the sheet S of the minimum size that can be fed by the feeding unit 3 in the width direction. Therefore, even in a case of the sheet S of the minimum size that can be fed by the sheet feeding device 1, the sheet feeding device 1 can reliably detect a skew of the sheet S occurred while the sheet S is fed.

Furthermore, the sheet feeding device 1 according to the present embodiment includes the deviation calculating unit 55 that calculates a deviation between moving amounts of the sheet S detected by the left-side encoder 71 and the right-side encoder 72. The skew detecting unit 54 detects a skew of the sheet S based on the deviation. Therefore, it is possible to detect a skew of the sheet S depending on whether moving amounts of the sheet S detected at two points in the width direction of the sheet S widely differ from each other.

Moreover, in the sheet feeding device 1 according to the present embodiment, when the deviation calculated by the deviation calculating unit 55 is equal to or larger than the threshold Th2 for determining a cumulative skew, the skew detecting unit 54 detects a skew of the sheet S while being fed by the feeding unit 3. Therefore, when a difference between the moving amounts of the sheet S detected by the left-side encoder 71 and the right-side encoder 72 exceeds the acceptable range, the skew detecting unit 54 can detect a cumulative skew, i.e., a skew of the sheet S while being fed.

Furthermore, the sheet feeding device 1 according to the present embodiment includes the sheet stacking table 2 on which sheets S are stacked and the separating unit 4 that separates the sheets S fed from the sheet stacking table 2 by the feeding unit 3 one by one. The encode disks 73 of the left-side encoder 71 and the right-side encoder 72 are arranged in the upstream side of the separating unit 4 in the feeding direction of the sheet S, so that the left-side encoder 71 and the right-side encoder 72 can respectively detect a moving amount of the sheet S in the upstream side of the separating unit 4 where it may easily cause a damage on the sheet S if a skew of the sheet S occurs. Therefore, it is possible to detect a skew of the sheet S while being fed before the sheet S reaches the separating unit 4.

Moreover, in the sheet feeding device 1 according to the present embodiment, the encode disks 73 of the left-side encoder 71 and the right-side encoder 72 are arranged in the downstream side of the feeding unit 3 in the feeding direction of the sheet S. Therefore, it is possible to detect a tilt of a leading edge (an edge in the downstream side of the feeding direction) of the sheet S with respect to the width direction based on moving amounts of the sheet S detected by the left-side encoder 71 and the right-side encoder 72. Consequently, it is possible to detect a leading edge skew, i.e., a skew occurred when the sheet S is set up askew from the beginning in addition to a cumulative skew.

Furthermore, in the sheet feeding device 1 according to the present embodiment, the left-side encoder 71 and the right-side encoder 72 are aligned along the width direction perpendicular to the feeding direction of the sheet S. Therefore, the left-side encoder 71 and the right-side encoder 72 can respectively detect a moving amount of the sheet S fed by the feeding unit 3 at a plurality of points in the width direction of the sheet S. Therefore, for example, when the sheet S is not skewed, and the leading edge of the sheet S is not tilted with respect to the width direction, the left-side encoder 71 and the right-side encoder 72 can simultaneously start detecting the moving amount of the sheet S at a plurality of points in the width direction of the sheet S.

Moreover, in the sheet feeding device 1 according to the present embodiment, when either one of the left-side encoder 71 and the right-side encoder 72 does not detect a moving amount of the sheet S, and also a moving amount of the sheet S detected by the other encoder is equal to or larger than the threshold Th1 for determining a leading edge skew of the sheet S, the skew detecting unit 54 detects a leading edge skew of the sheet S. Therefore, when either one of the left-side encoder 71 and the right-side encoder 72 does not detect a moving amount of the sheet S, and also a moving amount of the sheet S detected by the other encoder is equal to or larger than the threshold Th1, it is possible to detect that a leading edge of the sheet S is tilted at an angle exceeding the acceptable range with respect to the width direction perpendicular to the feeding direction, and thus it is possible to detect a skew of the leading edge of the sheet S, i.e., a leading edge skew.

Furthermore, the sheet feeding device 1 according to the present embodiment further includes the feed stop unit 56 that causes the feeding unit 3 to stop feeding the sheet S when the skew detecting unit 54 detects a skew of the sheet S. Therefore, it is possible to prevent a damage on the sheet S or a jam that may occur if the skewed sheet S is kept being fed.

The sheet feeding device and the skew detecting method according to the present invention are not limited to the above embodiment, and various changes can be made without departing from the spirit and scope of claims. In the above embodiment, the sheet feeding device and the skew detecting method are applied to the image reading apparatus, such as an image scanner, a copier, a facsimile machine, or a character recognition device. However, the sheet feeding device and the skew detecting method can be also applied to any other apparatuses.

Moreover, according to the present embodiment, two encoders, i.e., the left-side encoder 71 and the right-side encoder 72 are provided to the sheet feeding device as a plurality of moving-amount detecting units. However, it is also possible to provide three or more moving-amount detecting units. In addition, in the above embodiment, the rotary encoder is employed as the moving-amount detecting units. However, as long as a moving amount can be detected in accordance with a movement of the sheet, any other detecting units can be employed as the moving-amount detecting units.

Furthermore, according to the present embodiment, the encode disks 73 of the left-side encoder 71 and the right-side encoder 72 are arranged in the downstream side of the pick roller 31 and also in the upstream side of the separator roller 41 in the feeding direction. Alternatively, the encode disks 73 can be arranged at other location, for example, in the upstream side of the pick roller 31. Moreover, in the above embodiment, the encode disks 73 of the left-side encoder 71 and the right-side encoder 72 are aligned along the width direction perpendicular to the feeding direction of the sheet S. Alternatively, the encode disks 73 can be shifted along the feeding direction as long as the left-side encoder 71 and the right-side encoder 72 can detect a moving amount of the sheet S at a plurality points in the width direction of the sheet S.

Moreover, according to the present embodiment, the pulse counting unit 57 as a counting unit separately obtains the first pulse count values $P_{left\text{-}1}$ and $P_{right\text{-}1}$ for detecting a leading edge skew and the second pulse count values $P_{left\text{-}2}$ and $P_{right\text{-}2}$ for detecting a cumulative skew. Alternatively, the pulse counting unit 57 can obtain the first and second pulse count values all at once. Namely, once the pulse counting unit 57 finishes counting the number of the first pulses for the first pulse count values $P_{left\text{-}1}$ and $P_{right\text{-}1}$, the pulse counting unit 57 can continuously count the number of the second pulses for the second pulse count values $P_{left\text{-}2}$ and $P_{right\text{-}2}$ to obtain a cumulative total pulse count value.

As described above, according to an aspect of the present invention, a plurality of moving-amount detecting units respectively detect a moving amount of the sheet fed by a feeding unit at a plurality of points in the width direction of the sheet, and a skew detecting unit detects a skew of the sheet based on the moving amounts of the sheet detected by the moving-amount detecting units. Namely, when the moving amounts of the sheet detected at the points in the width direction of the sheet differ from one another, the skew detecting unit detects a skew of the sheet. Therefore, even after a leading edge of the sheet passes through the moving-amount detecting units, it is possible to detect a skew of the sheet occurred while the sheet is fed.

Furthermore, according to another aspect of the present invention, each of the moving-amount detecting units includes a disk-shaped rotational body that rotates in accordance with a movement of the sheet by having contact with the sheet, and detects a moving amount of the sheet with an encode pattern formed on the rotational body. Therefore, the sheet is fed in a feeding direction relative to the rotational body, so that it is possible to detect the moving amount of the sheet in whole area of the sheet along the feeding direction. Consequently, it is possible to detect a skew of the sheet occurred while the sheet is fed in whole area of the sheet along the feeding direction.

Moreover, according to still another aspect of the present invention, as a moving amount of the sheet decreases, a pulse width of an output pulse waveform of a pulse signal output from each of the moving-amount detecting units widens, so that the number of pulses of the output pulse waveform decreases. On the other hand, as a moving amount of the sheet increases, a pulse width of an output pulse waveform of a pulse signal output from each of the moving-amount detecting units narrows, so that the number of pulses of the output pulse waveform increases. Therefore, the number of pulses of each of the output pulse waveforms counted by a counting unit can be used as a value corresponding to the moving amount of the sheet. Consequently, the skew detecting unit can detect a skew of the sheet based on the number of pulses.

Furthermore, according to still another aspect of the present invention, at least one of the moving-amount detecting units is arranged on each side of the sheet in the width direction. Therefore, when the sheet is skewed, a difference between moving amounts of the sheet detected by the moving-amount detecting units relatively increases, and thus it is possible to detect a skew of the sheet more precisely.

Moreover, according to still another aspect of the present invention, the moving-amount detecting units detect at least moving amounts of both edges of the sheet of the minimum size that can be fed by the feeding unit in the width direction. Therefore, even in a case of the sheet of the minimum size that can be fed by the sheet feeding device, the moving-amount detecting units can detect the moving amounts, and thus it is possible to detect a skew of the minimum size of the sheet occurred while the sheet is fed reliably.

Furthermore, according to still another aspect of the present invention, a deviation calculating unit calculates a deviation between moving amounts of the sheet detected at the points in the width direction of the sheet, and the skew detecting unit detects a skew of the sheet based on the deviation. Therefore, it is possible to detect a skew of the sheet depending on whether the moving amounts of the sheet detected at the points in the width direction of the sheet widely differ from one another.

Moreover, according to still another aspect of the present invention, when the deviation calculated by the deviation calculating unit is equal to or larger than a threshold for determining a cumulative skew, the skew detecting unit detects a skew of the sheet being fed by the feeding unit. Therefore, when a difference between a moving amount of the sheet detected by one of the moving-amount detecting units and a moving amount of the sheet detected by another one of the moving-amount detecting units exceeds an acceptable range, it is possible to detect a cumulative skew of the sheet, i.e., a skew of the sheet being fed.

Furthermore, according to still another aspect of the present invention, the moving-amount detecting units are arranged in the upstream side of a separating unit in the feeding direction of the sheet. Therefore, it is possible to detect moving amounts of the sheet in the upstream side of the separating unit where it may easily cause a damage on the sheet if a skew of the sheet occurs, and thus it is possible to detect a skew of the sheet being fed before the sheet reaches the separating unit.

Moreover, according to still another aspect of the present invention, the moving-amount detecting units are arranged in the downstream side of the feeding unit in the feeding direction of the sheet. Therefore, it is possible to detect a tilt of a leading edge (an edge in the downstream side of the feeding direction) of the sheet with respect to the width direction based on moving amounts of the sheet detected by the moving-amount detecting units. Consequently, it is possible to detect a leading edge skew, i.e., a skew occurred when the sheet is set up askew from the beginning.

Furthermore, according to still another aspect of the present invention, the moving-amount detecting units are aligned along the width direction perpendicular to the feeding direction of the sheet, so that the moving-amount detecting units can respectively detect a moving amount of the sheet fed by the feeding unit at a plurality of points in the width direction of the sheet. Therefore, for example, when the sheet is not skewed, and the leading edge of the sheet is not tilted with respect to the width direction, the moving-amount detecting units can simultaneously start detecting the moving amounts of the sheet at a plurality of points in the width direction of the sheet.

Moreover, according to still another aspect of the present invention, when any one of the moving-amount detecting units does not detect a moving amount of the sheet, and also a moving amount of the sheet detected by at least one of the other moving-amount detecting units is equal to or larger than a threshold for determining a leading edge skew, the skew detecting unit detects that the leading edge of the sheet is tilted at an angle exceeding the acceptable range with respect to the width direction perpendicular to the feeding direction, and thus it is possible to detect a skew of the leading edge of the sheet, i.e., a leading edge skew.

Furthermore, according to still another aspect of the present invention, a feed stop unit causes the feeding unit to stop feeding the sheet when the skew detecting unit detects a skew of the sheet. Therefore, it is possible to prevent a damage on the sheet or a jam that may occur if the skewed sheet is kept being fed.

Moreover, according to still another aspect of the present invention, moving amounts of the sheet at a plurality of points in the width direction of the sheet fed by the feeding unit are detected at a moving-amount detecting step, and a skew of the sheet is detected based on the moving amounts at a skew detecting step. Therefore, when the moving amounts of the sheet at the points in the width direction of the sheet differ from one another, a skew of the sheet can be detected. Consequently, it is possible to detect a skew occurred while the sheet is fed reliably.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeding device comprising:

a feeding unit configured to feed a sheet;

a plurality of moving-amount detecting units for respectively detecting moving amounts of the sheet fed by the feeding unit at a plurality of points in a width direction of the sheet;

a deviation calculating unit configured to calculate a deviation between a moving amount of the sheet on the left side of a feeding direction of the sheet and a moving amount of the sheet on the right side of the feeding direction of the sheet, the left side moving amount and the right side moving amount respectively detected by the plurality of moving amount detecting units;

a skew detecting unit configured to detect both a skew of a leading edge of the sheet and a cumulative skew based on a relation between the deviation calculated by the deviation calculating unit and predetermined threshold values; and a feed stop unit configured to cause the feeding unit to stop feeding the sheet, wherein the feed stop unit is configured to stop the feeding unit from feeding the sheet when the skew detecting unit detects the cumulative skew of the sheet.

2. The sheet feeding device according to claim 1, wherein each of the moving-amount detecting units includes a disk-shaped rotational element configured to rotate with a movement of the sheet by having contact with the sheet, the rotational element includes an encode pattern formed along its circumference, and each of the moving-amount detecting units is configured to detect the moving amount of the sheet based on the encode pattern.

3. The sheet feeding device according to claim 2, further comprising a counting unit configured to count a number of output pulses from the moving-amount detecting units, wherein the skew detecting unit is configured to detect a skew of the sheet based on the number of output pulses counted by the counting unit.

4. The sheet feeding device according to claim 1, wherein at least one moving-amount detecting unit is arranged on each side of the sheet in the width direction.

5. The sheet feeding device according to claim 1, wherein the moving-amount detecting units is configured to detect at least a moving amount of both side edges of a sheet of a minimum size that can be fed by the feeding unit in the width direction.

6. The sheet feeding device according to claim 1, wherein the skew detecting unit is configured to detect the cumulative skew of the sheet when the deviation is equal to or larger than a predetermined threshold for determining the cumulative skew.

7. The sheet feeding device according to claim 1, further comprising:

a stacking unit on which a plurality of sheets is stacked; and a separating unit configured to separate the sheets fed from the stacking unit by the feeding unit one by one, wherein the moving-amount detecting units are arranged at an upstream side of the separating unit in a feeding direction of the sheet.

8. The sheet feeding device according to claim 1, wherein the moving-amount detecting units are arranged at a downstream side of the feeding unit in a feeding direction of the sheet.

9. The sheet feeding device according to claim 1, wherein the moving-amount detecting units are aligned in a direction perpendicular to a feeding direction of the sheet.

10. The sheet feeding device according to claim 9, wherein when any one of the moving-amount detecting units does not detect the moving amount of the sheet, and when the moving amount of the sheet detected by at least one of other moving-amount detecting units is equal to or larger than a predetermined threshold for determining a leading edge skew, the skew detecting unit is configured to detect a skew of a leading edge of the sheet.

11. A skew detecting method comprising:

detecting moving amounts of a sheet that is fed at a plurality of points in a width direction of the sheet;

calculating a deviation between a moving amount of the sheet on the left side of a feeding direction of the sheet and a moving amount of the sheet on the right side of the feeding direction of the sheet, the left side moving amount and the right side moving amount respectively detected in the moving amounts detecting; and detecting a skew of a leading edge of the sheet;

detecting a cumulative skew based on a relation between the calculated deviation and predetermined threshold values; and stopping feeding the sheet, wherein the step of stopping feeding the sheet is performed when the cumulative skew of the sheet is detected in the cumulative skew detecting.

* * * * *